US008837960B2

(12) United States Patent
Ge et al.

(10) Patent No.: US 8,837,960 B2
(45) Date of Patent: Sep. 16, 2014

(54) IMAGE FORMING APPARATUS

(75) Inventors: Wenxiang Ge, Ebina (JP); Toru Iwanami, Ebina (JP); Naoya Yamasaki, Ebina (JP); Gen Nakajima, Ebina (JP); Kenjo Nagata, Ebina (JP); Hidefumi Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 774 days.

(21) Appl. No.: 13/090,394

(22) Filed: Apr. 20, 2011

(65) Prior Publication Data

US 2012/0070163 A1 Mar. 22, 2012

(30) Foreign Application Priority Data

Sep. 17, 2010 (JP) ..... 2010-209353

(51) Int. Cl.
*G03G 15/08* (2006.01)

(52) U.S. Cl.
CPC .... *G03G 15/0831* (2013.01); *G03G 2215/0827* (2013.01); *G03G 15/0825* (2013.01); *G03G 2215/0888* (2013.01)
USPC ..... 399/27; 399/61; 399/90; 399/227

(58) Field of Classification Search
USPC ..... 399/27, 61, 90, 227
See application file for complete search history.

(56) References Cited

U.S. PATENT DOCUMENTS

| | | | | |
|---|---|---|---|---|
| 6,034,531 | A * | 3/2000 | Senglat et al. | 324/699 |
| 2012/0070164 | A1* | 3/2012 | Iwanami et al. | 399/27 |
| 2012/0114381 | A1* | 5/2012 | Okoshi | 399/227 |

FOREIGN PATENT DOCUMENTS

| | | | | |
|---|---|---|---|---|
| JP | 63317621 | A | | 12/1988 |
| JP | 06095528 | A | | 4/1994 |
| JP | 06267627 | A | | 9/1994 |
| JP | 09028060 | A | * | 1/1997 |
| JP | 10070846 | A | | 3/1998 |
| JP | 10133446 | A | | 5/1998 |
| JP | 2000-231255 | A | | 8/2000 |
| JP | 2001255734 | A | | 9/2001 |
| JP | 2001290335 | A | | 10/2001 |
| JP | 2002006692 | A | | 1/2002 |
| JP | 2002196558 | A | | 7/2002 |
| JP | 2007010848 | A | | 1/2007 |
| JP | 2008225513 | A | | 9/2008 |

OTHER PUBLICATIONS

Office Action issued by Japanese Patent Office in corresponding Japanese Patent Application No. 2010-209353, dated Apr. 15, 2014.

* cited by examiner

*Primary Examiner* — Ryan Walsh
(74) *Attorney, Agent, or Firm* — Sughrue Mion, PLLC

(57) ABSTRACT

An image forming apparatus includes an image carrier, and a rotation device having image-forming devices each containing a toner and forming a toner image on the image carrier with the toner. The apparatus further includes: a detector attached to at least one of the image-forming devices to detect a quantity of the toner, thereby outputting an analog signal representing the quantity; and a transmission path transmitting the analog signal to the outside of the rotation device. The transmission path includes: a rotation terminal mounted on and rotating with the rotation device; and a contact terminal provided outside the rotation device, and maintaining continuity with the rotation terminal by contacting a surface of the rotation terminal even when the rotation terminal rotates. The apparatus further includes a correction section correcting the analog signal transmitted by the transmission path, according to a contact resistance between the rotation terminal and the contact terminal.

5 Claims, 11 Drawing Sheets

FIG. 10A

| ROTATION DATE | ACCUMULATED TIME |
|---|---|
| JULY 1 | 5 HOURS |
| JULY 2 | 1 2 HOURS |
| JULY 3 | 1 8 HOURS |
| ⋮ | ⋮ |

FIG. 10B

| DATE | AVERAGE ROOM TEMPERATURE | ACCUMULATED TIME |
|---|---|---|
| JULY 1 | 2 2 | 5 |
| JULY 2 | 2 6 | 1 2 (7) |
| JULY 3 | 1 9 | 1 8 (6) |
| ⋮ | ⋮ | ⋮ |

IMAGE FORMING APPARATUS

CROSS-REFERENCE TO RELATED APPLICATION

This application is based on and claims priority under 35 USC 119 from Japanese Patent Application No. 2010-209353, filed Sep. 17, 2010.

BACKGROUND

Technical Field

The present invention relates to an image forming apparatus.

SUMMARY

According to an aspect of the invention, an image forming apparatus according to claim 1 includes an image carrier, a rotation device, a detector, a transmission path and a correction section. The image carrier is formed with an image on its surface and carries the image. The rotation device has plural image-forming devices each including a toner and forming a toner image on the surface of the image carrier with the toner, causes one of the image-forming devices to face the surface of the image carrier and to form the toner image, and rotates to change the image-forming device facing the surface of the image carrier. The detector is attached to at least one image-forming device of the plural image-forming devices, and detects a quantity of the toner included in the at least one image-forming device, to output an analog signal representing the quantity. The transmission path transmits the analog signal outputted by the detector, to the outside of the rotation device. The transmission path includes: a rotation terminal which is mounted on the rotation device and rotates together with the rotation device; and a contact terminal which is provided outside the rotation device, and contacts a surface of the rotation terminal to maintain continuity with the rotation terminal even when the rotation terminal rotates. The correction section corrects the analog signal transmitted through the transmission path according to a contact resistance between the rotation terminal and the contact terminal.

BRIEF DESCRIPTION OF THE DRAWINGS

Exemplary embodiments of the present invention will be described in detail based on the following figures, wherein:

FIG. 10A and FIG. 10B are diagrams that illustrate the correspondence between each piece of data on cumulative rotation time and each piece of data on environmental temperature.

DETAILED DESCRIPTION

Exemplary embodiments of the image forming apparatus of the present invention will be described below.

Figure 1:
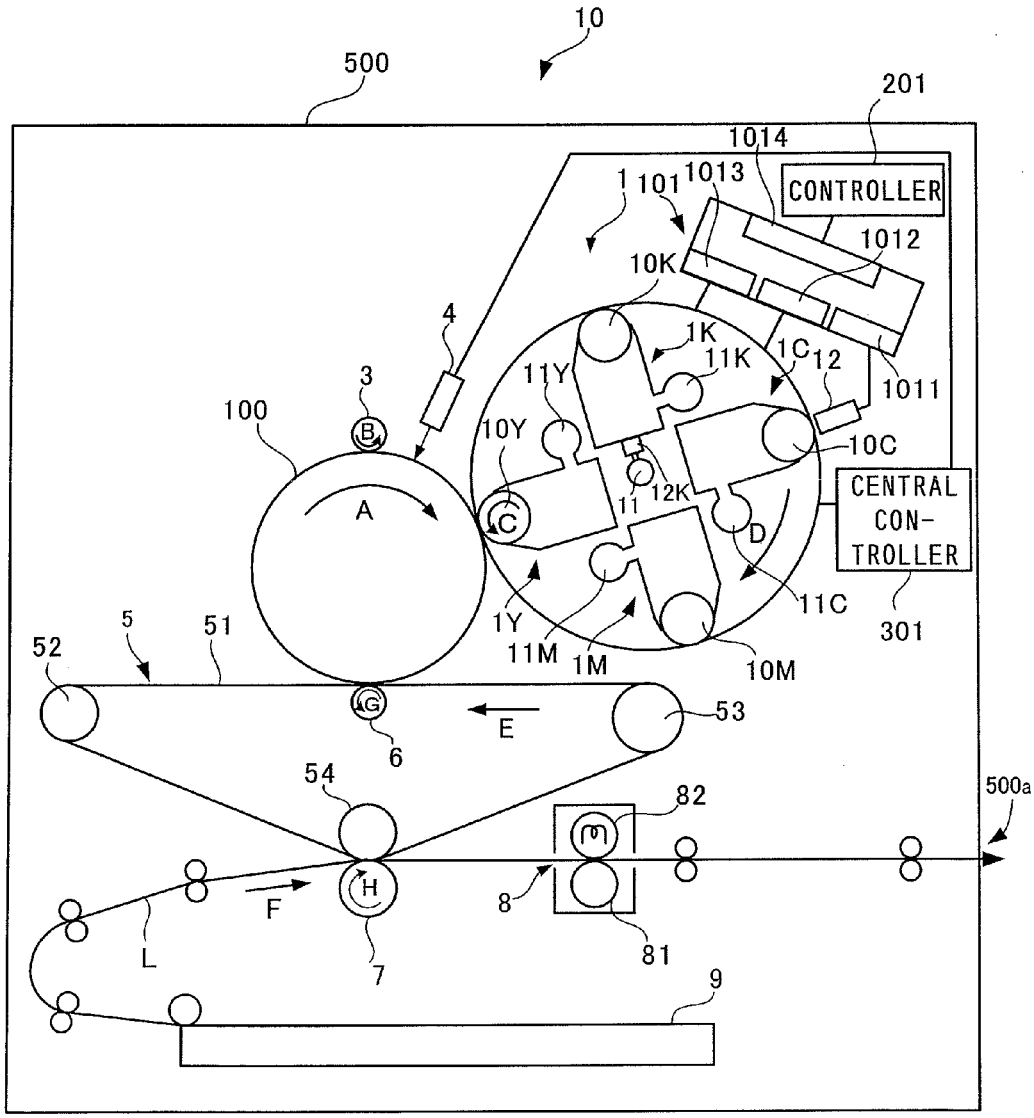
FIG. 1 is a schematic structural diagram of a printer according to a first exemplary embodiment.

FIG. 1 is a schematic structural diagram of a printer.

A printer 10 illustrated in FIG. 1 is a full color printer capable of forming a full color image on a recording medium. This printer 10 is a first exemplary embodiment of the image forming apparatus of the present invention.

This printer 10 has a housing 500, and a media cassette 9 is disposed in a bottom of the housing 500. In the media cassette 9, recording media are stacked and housed.

In this printer 10, the recording media are drawn one by one from the media cassette 9, and the drawn recording media are transported along a conveyance path L. Further, in this printer 10, although the details will be described later, a toner image is formed on a photoreceptor roll 100, and the formed toner image is transferred to a surface of the recording medium being conveyed. Further, the recording medium to which the toner image has been transferred is heated and pressurized so that the toner image is fixed to the surface of the recording medium. As a result, an image is formed on the recording medium. A medium ejection slot 500*a* is formed in the housing 500, and the recording medium with the surface to which the toner image is fixed is ejected from this medium ejection slot 500*a* to the outside of the printer 10.

The formation of the toner image, the transfer of the toner image and the fixing of the toner image in this printer 10 are performed as described below.

The photoreceptor roll 100 is provided above the media cassette 9. This photoreceptor roll 100 is a roll rotating in a direction of an arrow A and extending in a direction perpendicular to the surface of paper. The photoreceptor roll 100 is equivalent to an example of the image carrier according to an aspect of the present invention. Provided directly above this photoreceptor roll 100 is a charging roll 3. This charging roll 3 contacts the photoreceptor roll 100 rotating in the direction of the arrow A, and rotates in a direction of an arrow B by following the photoreceptor roll 100, thereby charging the surface of the photoreceptor roll 100. Above the upper right part of the photoreceptor roll 100, an exposure device 4 is provided. According to image data transmitted from a central controller 301 to be described later, the exposure device 4 exposes the surface of the photoreceptor roll 100 to which the charge is applied. As a result, an electrostatic latent image is formed on the surface of the photoreceptor roll 100. Provided on the right side of the photoreceptor roll 100 is a revolver developing unit 1. The central controller 301 is provided on the right side of the revolver developing unit 1.

The central controller 301 controls the operation of each part of this printer 10, including the revolver developing unit 1.

The revolver developing unit 1 includes four developing devices 1Y, 1M, 1C and 1K. This revolver developing unit 1 is equivalent to an example of the rotation device according to an aspect of to the present invention, and each of these four developing devices 1Y, 1M, 1C and 1K is equivalent to an example of the image- forming device according to an aspect of to the present invention.

These four developing devices 1Y, 1M, 1C and 1K are in charge of Y (yellow) color, M (magenta) color, C (cyan) color and K (black) color, respectively, and each of the developing devices includes a toner of the color handled by the developing device and a developer containing a magnetic carrier. Further, the developing devices 1Y, 1M, 1C and 1K have development rolls 10Y, 10M, 10C and 10K, respectively.

The revolver developing unit 1 has a rotation axis 11, and this rotation axis 11 is coupled to a stepping motor not illustrated. The central controller 301 controls the rotation angle of the revolver developing unit 1 to a direction of an arrow D through the stepping motor. The central controller 301 transmits the number of steps representing a rotation angle to the stepping motor, thereby causing the revolver developing unit 1 to rotate by only the angle corresponding to the number of steps. Thus, the central controller 301 causes the development roll of a desired one of the four developing devices 1Y, 1M, 1C and 1K provided in the revolver developing unit 1 to face the surface of the photoreceptor roll 100. FIG. 1 illustrates a state in which the development roll 10Y of the developing device 1Y containing the Y-color toner faces the photoreceptor roll 100. Further, the central controller 301 receives image data transmitted externally, separates down the received image data into the respective pieces of color data of Y color, M color, C color and K color, and transmits the pieces of color data to the exposure device 4.

Although the illustration is omitted, the development roll of each of the developing devices has a magnetic roll and a developing sleeve. The magnet roll contains built-in magnetic poles, and is fixedly disposed in the developing device. On the other hand, the developing sleeve is a cylinder covering an outer peripheral surface of the magnetic roll, and rotates in a direction of an arrow C relative to the magnetic roll.

In each of the developing devices, the developer is stirred and thereby, the toner and the magnetic carrier rub each other, and are electrically charged to be opposite to each other in polarity. For this reason, the toner and the magnetic carrier electrostatically adsorb each other, and are in complete harmony.

The magnetic carrier is attracted by a magnetic force from the magnetic roll. For this reason, the toner adhering to the magnetic carrier is held on the surface of the developing sleeve together with the magnetic carrier.

A voltage is applied to each of the development rolls, and an electric field, which generates an electrostatic force exceeding the electrostatic adsorbing force between the magnetic carrier and the toner, is formed between the electrostatic latent image on the surface of the photoreceptor roll 100 and the development roll facing the photoreceptor roll 100. Therefore, the toner held on the developing sleeve transfers to the electrostatic latent image, and the electrostatic latent image is developed with the toner. As a result, the toner image is formed on the surface of the photoreceptor roll 100, and the photoreceptor roll 100 holds the toner image on the surface.

Provided on the upper right part of the revolver developing unit 1 is a controller 201. The revolver developing unit 1 includes four toner dispensing devices 11Y, 11M, 11C and 11K corresponding to the four developing devices 1Y, 1M, 1C and 1K, respectively. Each of the toner dispensing devices includes a built-in toner transport member. Specifically, this toner transport member has such a structure that a spiral fin is disposed around a rod. Further, the toner transport member rotates while receiving an ON-signal from the controller 201 and thereby supplies the developing device with the toner. When the signal changes to OFF, the toner transport member stops rotating and also halts the supply of the toner.

This printer 10 is provided with an optical sensor 12 and a permeability sensor 12K that detects the permeability of the developer contained in the developing device 1K for K color. In this printer 10, although the details will be described later, the controller 201 controls the toner density of the developer contained in each of the four developing devices 1Y, 1M, 1C and 1K, by using these optical sensor 12 and permeability sensor 12K.

Provided below the photoreceptor roll 100 is an intermediate transfer unit 5. This intermediate transfer unit 5 has an intermediate transfer belt 51. The intermediate transfer belt 51 is an endless belt that circularly moves along a predetermined path in a direction of an arrow E, and the toner image held on the surface of the photoreceptor roll 100 is transferred to the surface of the intermediate transfer belt 51. The intermediate transfer belt 51 is held around three rolls 52, 53 and 54 to be described later.

Further, the intermediate transfer unit 5 has a primary transfer roll 6. The primary transfer roll 6 is disposed opposite the photoreceptor roll 100 over the intermediate transfer belt 51 interposed in between, and rotates in a direction of an arrow G by following the circulation of the intermediate transfer belt 51 in the direction of the arrow E. The intermediate transfer belt 51 is interposed between the primary transfer roll 6 and the photoreceptor roll 100 holding the toner image on the surface. Because a potential of the polarity opposite to the polarity of the charged toner is given to the primary transfer roll 6, the toner image formed on the surface of the photoreceptor roll 100 is electrostatically attracted by the primary transfer roll 6. As a result, the toner image is transferred to the surface of the intermediate transfer belt 51 circularly moving in the direction of the arrow E.

Further, the intermediate transfer unit 5 has the drive roll 52, the tension roll 53 and the opposite roll 54, and as mentioned above, the intermediate transfer belt 51 is held around these three rolls.

The drive roll 52 rotates by obtaining a rotation driving force from a driving source not illustrated. Thus, the intermediate transfer belt 51 circularly moves in the direction of the arrow E. The tension roll 53 and the opposite roll 54 rotate by following the circulation of the intermediate transfer belt 51 in the direction of the arrow E. Incidentally, the opposite roll 54 faces a second transfer roll 7 to be described later, across the intermediate transfer belt 51 interposed in between, and aids the secondary transfer of the toner image, which has been transferred to the surface of the intermediate transfer belt 51, to the recording medium.

The second transfer roll 7 is disposed below the intermediate transfer unit 5, across the conveyance path L of the recording medium interposed in between. The potential of the polarity opposite to the polarity of the toner is given to the second transfer roll 7. The second transfer roll 7 rotates in a direction of an arrow H, by following the circularly moving of the intermediate transfer belt 51 in the direction of the arrow E. Further, the recording medium is drawn out from the media cassette 9 and comes along the conveyance path L. The recording medium comes in between the second transfer roll 7 and the intermediate transfer belt 51 having the toner image held on the surface. As a result, the toner image after being transferred to the surface of the intermediate transfer belt 51 is transferred to the recording medium.

Disposed on the right side of the second transfer roll 7 is a fuser 8. The fuser 8 has a pressure roll 81 and a heating roll 82. The pressure roll 81 and the heating roll 82 rotate while holding therebetween the recording medium having the transferred toner image and conveyed in a direction of an arrow F, and heat and pressurize the recording medium. As a result, the toner image transferred to the recording medium is fused and fixed onto the recording medium by being pressed against the recording medium, and thereby the image is formed on the recording medium.

Here, an operation of forming the full color image in the printer 10 having the revolver developing unit 1 will be briefly described. In this printer 10, the full color image is formed by forming, at first, a Y-color toner image, and subsequently by forming an M-color toner image, a C-color toner image and a K-color toner image, sequentially.

In this printer 10, at first, the charging roll 3 charges the surface of the photoreceptor roll 100 rotating in the direction of the arrow A, and the central controller 301 transmits image data for the Y color among the image data separated into the pieces for the respective colors of Y, M, C and K to the exposure device 4. The exposure device 4 starts the exposure according to the image data for the Y color, with timing when the charged part of the surface of the photoreceptor roll 100 by the charging roll 3 arrives. As a result, an electrostatic latent image for the Y color is formed on the surface of the photoreceptor roll 100. In timing for the formation of the electrostatic latent image for the Y color, the central controller 301 causes the revolver developing unit 1 to rotate, so that the development roll 10Y faces the photoreceptor roll 100. This allows the developing device 1Y for the Y color to develop the electrostatic latent image for the Y color with the Y-color toner. Subsequently, the Y-color toner image is transferred to the surface of the intermediate transfer belt 51 by the primary transfer roll 6.

Next, of the photoreceptor roll 100, the part after finishing the transfer of the Y-color toner image is charged by the charging roll 3 again. The central controller 301 next transmits the image data for the M color to the exposure device 4. The exposure device 4 exposes the charged surface of the photoreceptor roll 100 according to this image data for the M color, and thereby an electrostatic latent image for the M color is formed on the surface of the photoreceptor roll 100. In timing of the formation of the electrostatic latent image for the M color, the central controller 301 causes the revolver developing unit 1 to rotate, so that the development roll 10M of the developing device 1M for the M color faces the photoreceptor roll 100. This allows the developing device 1M for the M color to develop the electrostatic latent image for the M color with the M-color toner. The Y-color toner image after transferred to the intermediate transfer belt 51 has been already moved in the direction of the arrow E. However, the secondary transfer by the second transfer roll 7 is not carried out, and the Y-color toner image comes again to where the primary transfer roll 6 is located, so that the M-color toner image is transferred to the Y-color toner image. Afterwards, the above-described cycle is repeated also for each of the C color and the K color, and thereby the toner images of the four colors are laminated on the intermediate transfer belt to be a layered toner image. The layered toner image on which the last K-color toner image is transferred is transferred onto the recording medium by the second transfer roll 7. Subsequently, the layered toner image after transferred onto the recording medium is fixed onto the recording medium by the fuser 8.

Here, a method of controlling the toner density of each of the four developing devices 1Y, 1M, 1C and 1K will be described.

This printer 10 includes, as mentioned earlier, the optical sensor 12 and the permeability sensor 12K.

This optical sensor 12 is fixedly disposed outside the revolver developing unit 1, and detects the toner quantity of the developer contained in each of the developing devices 1Y, 1M and 1C in charge of the Y, M and C colors except the K color among the four colors.

This optical sensor 12 has a light-emitting section and a light-receiving section. The optical sensor 12 emits, with the light-emitting section, a predetermined amount of light toward the development rolls 10Y, 10M and 10C each carrying the developer on the surface. Further, the optical sensor 12 receives, with the light-receiving section, the light reflected upon and coming back from the development rolls 10Y, 10M and 10C each carrying the developer on the surface, and the optical sensor 12 outputs an analog signal corresponding to the amount of the received light. The analog signal outputted by the optical sensor 12 is sent to an analog-to-digital converter (this analog-to-digital converter will be hereinafter referred to as an A/D converter) 101. When a change occurs in the toner quantity of the developer contained in each of the developing devices 1Y, 1M and 1C, the toner quantity of the developer held on the surface of each of the development rolls 10Y, 10M and 10C also changes, causing a change in the amount of the reflected light. As a result, the signal outputted by the optical sensor 12 changes according to the change in the toner quantity.

The A/D converter 101 has first, second and third detecting sections 1011, 1012 and 1013 that detect the analog signal. The analog signal transmitted from the optical sensor 12 is detected by the first detecting section 1011 of these three detecting sections.

The first detecting section 1011 detects the analog signal reflecting the toner quantity in each of the developing devices in charge of the Y, M and C colors except for the K color of the four colors, converts the detected signal into a digital signal, and transmits the digital signal to the controller 201. Upon detecting a decrease in the toner quantity from the transmitted digital signal, the controller 201 instructs the toner dispensing devices 11Y, 11M and 11C to supply the developing devices 1Y, 1M and 1C with the toners. Incidentally, when the development roll 10Y of the developing device 1Y for the Y color faces the photoreceptor roll 100, the optical sensor 12 faces the development roll 10C of the developing device 1C for the C color and transmits the analog signal reflecting the toner quantity of the developer contained in the developing device 1C for the C color to the first detecting section 1011. Further, when the development roll 10C of the developing device 1C for the C color faces the photoreceptor roll 100, the optical sensor 12 faces the development roll 10Y of the developing device 1Y for the Y color, and transmits the analog signal reflecting the toner quantity of the developer contained in the developing device 1Y for the Y color to the first detecting section 1011.

The permeability sensor 12K is attached to the developing device 1K for the K color. The permeability sensor 12K transmits the analog signal according to the permeability of the developer contained in the developing device 1K, to the A/D converter 101 disposed outside the revolver developing unit 1, via a transmission path to be described later. The A/D converter 101 detects this analog signal, with the second detecting section 1012 of the three detecting sections. This permeability sensor 12K is equivalent to an example of the detector according to an aspect of the present invention.

Incidentally, when a decrease occurs in the toner quantity of the developer contained in the developing device 1K for the K color, the proportion of the magnetic carrier that is a magnetic substance increases, and thereby the permeability rises. For this reason, the permeability reflects the toner quantity, the analog signal outputted by the permeability sensor 12K reflects the toner quantity as well. In other words, the permeability sensor 12 is substantially a sensor detecting the toner quantity, and this permeability sensor 12K is equivalent to an example of the detector according to an aspect of to the present invention. Upon detecting the analog signal transmitted by the permeability sensor 12K and representing the permeability that reflects the toner quantity, the second detecting section 1012 converts the detected signal into a digital signal, and transmits the digital signal to the controller 201. When a decrease in the toner quantity occurs in the developing device 1K for the K color, the controller 201 instructs the toner dispensing device 11K to supply the developing device 1K with the toner. Incidentally, the A/D converter 101 has a switching (S/W) system 1014, and the switching system 1014 switches the transmission of the digital signal to the controller 201 by the detecting sections.

The reason why there is such a difference between the method of detecting the toner quantity for the K color and those of other three colors is because the magnetic carrier is black and thus, the optical sensor 12 is unable to detect fluctuations in the proportion of the K color toner contained in the developer carried by the development roll 10K for the K color.

Next, there will be described a slip ring system for transmitting the analog signal representing the permeability detected by the permeability sensor 12K to the controller 201 disposed outside the revolver developing unit 1.

Figure 2:
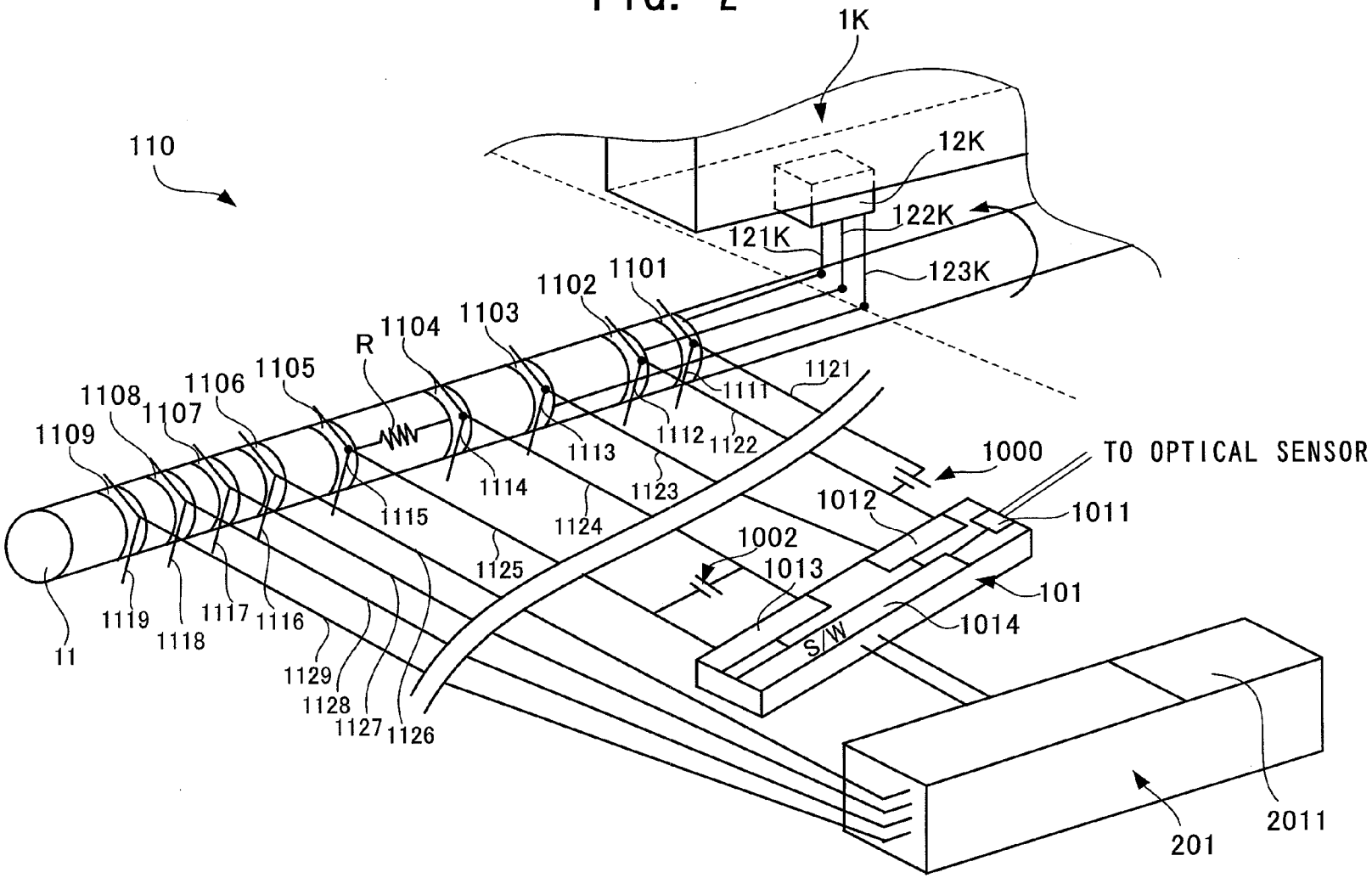
FIG. 2 is a schematic structural diagram of a slip ring system.

FIG. 2 is a schematic structural diagram of the slip ring system.

FIG. 2 illustrates the developing device 1K for the K color to which the permeability sensor 12K is attached.

The slip ring system 110 includes first to ninth slip rings 1101, 1102, 1103, 1104, 1105, 1106, 1107, 1108 and 1109. Further, the slip ring system 110 includes, as an element, the rotation axis 11 that is also an element of the revolver developing unit 1.

These first to ninth slip rings are metal rings, and the rotation axis 11 is a resin rod. These first to ninth slip rings are attached to the rotation axis 11 with space in between, and rotate with the rotation axis 11.

Further, this slip ring system 110 includes first to ninth wire brushes 1111, 1112, 1113, 1114, 1115, 1116, 1117, 1118 and 1119.

These first to ninth wire brushes are provided corresponding to the first to the ninth slip rings, and the first to the ninth slip rings and the first to the ninth wire brushes contact each other.

Furthermore, this slip ring system 110 includes first to ninth lead wires 1121, 1122, 1123, 1124, 1125, 1126, 1127, 1128 and 1129.

These first to ninth lead wires are connected to the first to the ninth wire brushes, respectively.

The first to the ninth wire brushes and the first to the ninth lead wires are fixedly disposed irrespective of the rotation of the revolver developing unit 1. However, since the first to the ninth slip rings are present on the entire circumference of the rotation axis 11, even when the first to the ninth wire brushes are disposed fixedly, the first to the ninth wire brushes constantly contact the surfaces of the slip rings rotating together with the rotation axis 11, and the continuity between the first to the ninth slip rings and the first to the ninth wire brushes is maintained.

FIG. 2 illustrates only the developing device 1K for the K color for convenience of explanation, but actually, the four developing devices are disposed around the rotation axis 11. In an area above a dotted line illustrated in FIG. 2, the four developing devices disposed around the rotation axis 11 rotate with the rotation axis 11. For this reason, the wire brushes are not disposed in the area above the dotted line. On the other hand, in an area below the dotted line illustrated in FIG. 2, only the rotation axis 11 rotates even when the developing devices rotate and thus, the wire brushes are disposed fixedly.

The first slip ring 1101 is disposed at a position closest to the developing devices, and the second slip ring 1102 as well as the subsequent slip rings are disposed sequentially in a direction of leaving the developing devices.

Incidentally, in the following, a path including the first slip ring 1101, the first wire brush 1111 and the first lead wire will be referred to as a first transmission path. Similarly, second to ninth paths including the second to the ninth slip rings, the second to the ninth wire brushes and the second to the ninth lead wires will be referred to as second to ninth transmission paths, respectively.

The permeability sensor 12K has a power line 121K, a ground wire 122K and a signal line 123K. The power line 121K is connected to the first slip ring 1101 of the first transmission path, and the ground wire 122K is connected to the second slip ring 1102 of the second transmission path. Further, the signal line 123K is connected to the third slip ring 1103 of the third transmission path.

Between the first lead wire 1121 of the first transmission path and the second lead wire 1122 of the second transmission path, a first power supply 1000 is connected. This first power supply 1000 is a constant-voltage power supply, and supplies a constant voltage to the permeability sensor 12K through these above-described first and second transmission paths.

The second lead wire 1122 of the second transmission path and the third lead wire 1123 of the third transmission path are connected to the second detecting section 1012 of the A/D converter 101, and the analog signal reflecting the toner quantity is transmitted to the second detecting section 1012 through the second and third transmission paths. The second slip ring 1102 and the third slip ring 1103 are each equivalent to an example of the rotation terminal according to an aspect of the present invention, and the second wire brush 1112 and the third wire brush 1113 are each equivalent to an example of the contact terminal according to an aspect of to the present invention. Further, the combination of the second transmission path and the third transmission path is equivalent to an example of the transmission path according to an aspect of to the present invention.

Incidentally, the fourth transmission path for the fourth slip ring 1104 and the fifth transmission path for the fifth slip ring 1105 illustrated in FIG. 2 will be described later.

The sixth to the ninth transmission paths including the sixth to the ninth slip springs, the sixth to the ninth wire brushes and the sixth to the ninth lead wires are transmission paths for giving toner-supply instructions from the controller 201 to the respective toner dispensing devices.

In other words, the sixth to the ninth slip rings are connected to the toner dispensing devices 11Y, 11M, 11C and 11K for the Y color, M color, C color and K color (see FIG. 1), respectively. Further, the sixth to the ninth lead wires are connected to the controller 201.

In the controller 201, the toner density in each of the developing devices is grasped, based on a signal from the permeability sensor 12K via the second detecting section 1012 for the K color, and based on a signal from the optical sensor 12 via the first detecting section 1011 for other colors. For the developing device requiring the toner supply, an ON signal is transmitted to the corresponding toner dispensing device by using the sixth to the ninth transmission paths. Incidentally, this controller 201 has a storage section 2011 that will be described later in detail.

Incidentally, the signal transmitted from the permeability sensor 12K to the second detecting section 1012 is an analog signal and thus, the level of the signal serves as a piece of important information. However, the transmission of the analog signal from the permeability sensor 12K to the second receiving part 1012 is performed via the third slip ring 1103 and the third wire brush 1113 and therefore, when a change takes place in the contact resistance between the third slip ring 1103 and the third wire brush 1113, the level of the analog signal is affected. Therefore, the change in the contact resistance between the third slip ring 1103 and the third wire brush 1113 affects the control of the toner supply and by extension affects the control of the toner density.

Figure 3:
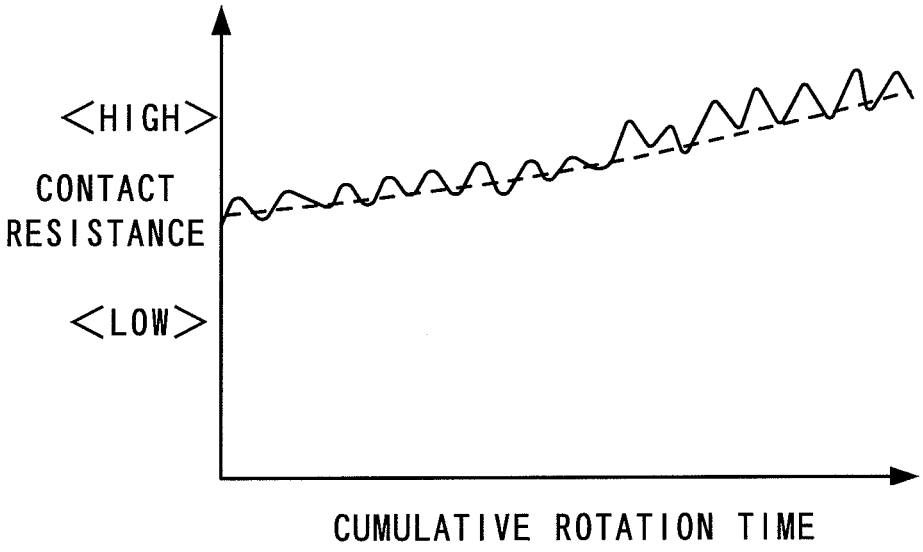
FIG. 3 is a graphical diagram that illustrates the relation between cumulative rotation time and contact resistance.

FIG. 3 is a graphical diagram that illustrates the relation between the cumulative rotation time and the contact resistance.

FIG. 3 illustrates a state in which the contact resistance between the slip ring and the wire brush rises while having small variations, as the cumulative rotation time of the revolver developing unit 1 becomes longer. A conceivable cause of this is the fact that as the contact time between the slip ring and the wire brush becomes longer, a lubricant applied between the slip ring and the wire brush deteriorates, and a resistance value of the lubricant itself increases. Another conceivable cause is the fact that abrasion powder produced by abrasion between the slip ring and the wire brush obstructs the contact between the slip ring and the wire brush.

If the contact resistance between the third slip ring 1103 and the third wire brush 1113 rises in this way, even when the permeability sensor 12K has transmitted the analog signal of a same level to the A/D converter 101, the level of the analog signal detected by the second detecting section 1012 is not a true value. For this reason, the toner density control, by the controller 201 becomes inaccurate.

Thus, it is conceivable that an A/D converter that converts an analog signal from the permeability sensor 12K into a digital signal may be provided inside the revolver developing unit 1. In other words, the change in the contact resistance between the third slip ring 1103 and the third wire brush 1113 will be addressed by converting the analog signal into the digital signal and then transmitting the digital signal to the controller 201 through this slip ring system.

However, in this case, the A/D converter dedicated to the K color is provided inside the revolver developing unit 1, which is a waste of facility since the A/D converter 101 is provided outside the revolver developing unit 1.

Thus, in this printer 10, a true signal level is obtained from the analog signal whose level rose due to the rise in the contact resistance between the third slip ring 1103 and the third wire brush 1113. The true signal level (this true signal level will be hereinafter referred to as a voltage true value) is a value that would have been obtained if there had been no rise in the contact resistance. Incidentally, in the following, assuming that the contact resistance between the third slip ring 1103 and the third wire brush 1113 has already been obtained, how to determine the voltage true value will be described and then, how to determine the contact resistance will be described.

In the present exemplary embodiment, in order to obtain basic information for determining the voltage true value, for the third slip ring 1103 and the third wire brush 1113, a change in the contact resistance value and a detected voltage value are determined by experiment for each of two or more voltage true values. The change in the contact resistance value is a change occurring during a period of time from a non-abrasion state to a state where the abrasion reaches the limit after increasing. The detected voltage value is detected by the second detecting section 1012 based on each contact resistance value. Then, for each of the voltage true values, an approximate expression in which the detected voltage value is expressed as a function of the contact resistance value is created and stored in the storage section 2011 of the controller 201.

Figure 4:
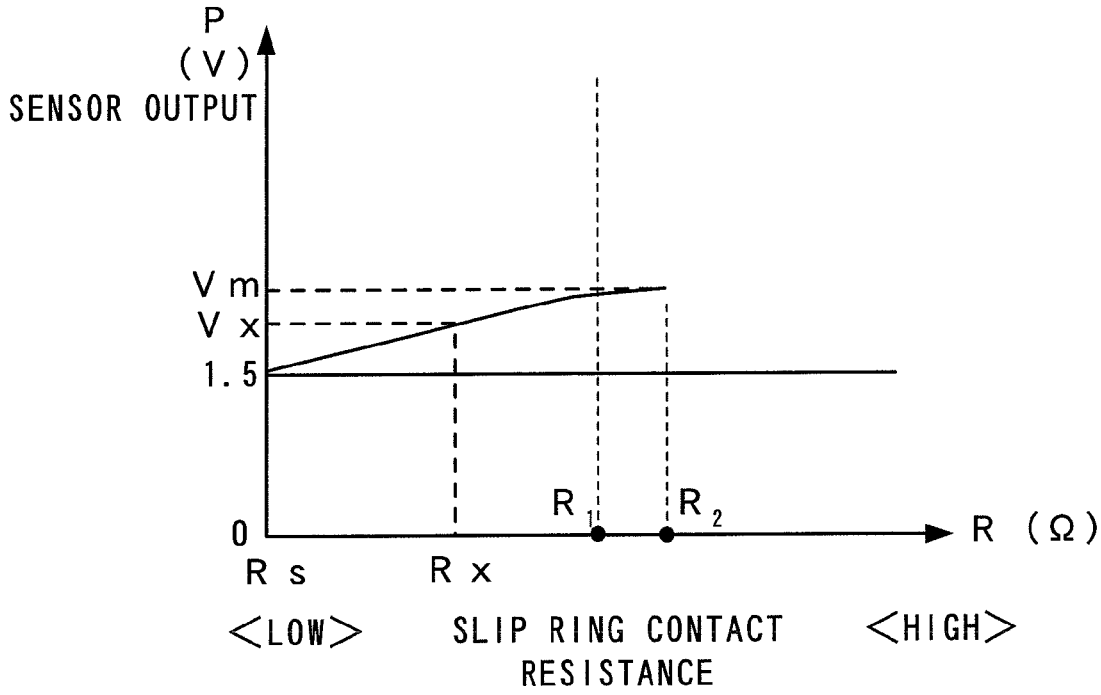
FIG. 4 is a first graphical diagram that illustrates the relation between the contact resistance and a detected voltage value.

FIG. 4 is a graphical diagram that illustrates the relation between the contact resistance and the detected voltage value. Incidentally, in the following, the contact resistance between the third slip ring 1103 and the third wire brush 1113 at the time of non-abrasion is represented by Rs, and the contact resistance at the time when the abrasion reaches the limit after increasing is represented by R2.

In FIG. 4, the relation between the contact resistance and the sensor output (in other words, the detected voltage value) , which is represented by one of the two or more approximate expressions stored in the storage section 2011 of the controller 201, is illustrated as a graph. The horizontal axis of the graph represents the contact resistance value, and the vertical axis represents the sensor output.

The example illustrated in FIG. 4 is a case where the voltage true value is 1.5V. The graph illustrated in FIG. 4 indicates that the sensor output equals to the voltage true value of 1.5V when the contact resistance is Rs that is a lower limit, and the sensor output is Vm (V) when the contact resistance increases and reaches the limit R2.

Including the approximate expression corresponding to the graph illustrated in FIG. 4, any of the approximate expressions stored in the storage section 2011 is expressed by the following form, where the sensor output is represented by P, and the contact resistance value is represented by Rx.

$$P=aRx+b(Rs\leq Rx\leq R_1)$$

$$P=cRx^2+dRx+e(R_1<Rx\leq R_2)$$

(a, b, c, d and e are coefficients varying among the voltage true values, and R1 is a boundary resistance value common to any of the voltage true values.)

The controller 201 determines the voltage true value based on such an approximate expression, as described below. For example, when the contact resistance between the third slip ring 1103 and the third wire brush 1113 when a voltage value Vx is detected by the second detecting section 1012 is Rx, the controller 201 substitutes this Rx into each of the approximate expressions, and each P(Rx) is calculated and compared with Vx. Here, when there is an approximate expression which becomes P(Rx)=Vx, a point (Rx, Vx) is a point in the graph as illustrated in FIG. 4, and the controller 201 obtains the voltage value P (1.5V in the example of FIG. 4) at the time when the contact resistance in the approximate expression is Rs, as the voltage true value. Subsequently, in the controller 201, 1.5V serving as this voltage true value is regarded as a value reflecting the toner quantity of the developer in the developing device 1K for the K color, and the toner supply is controlled based on this value. This controller 201 is equivalent to an example of the correction section according to an aspect of the present invention.

Further, in this controller 201, when any of the values P (Rx) calculated as described above does not agree with Vx, the voltage true value is determined as described below. In the following, there will be described, as an example, a case where the contact resistance at the time when the voltage value Vx is detected by the second detecting section 1012 is Rx between Rs and R1.

Figure 5:
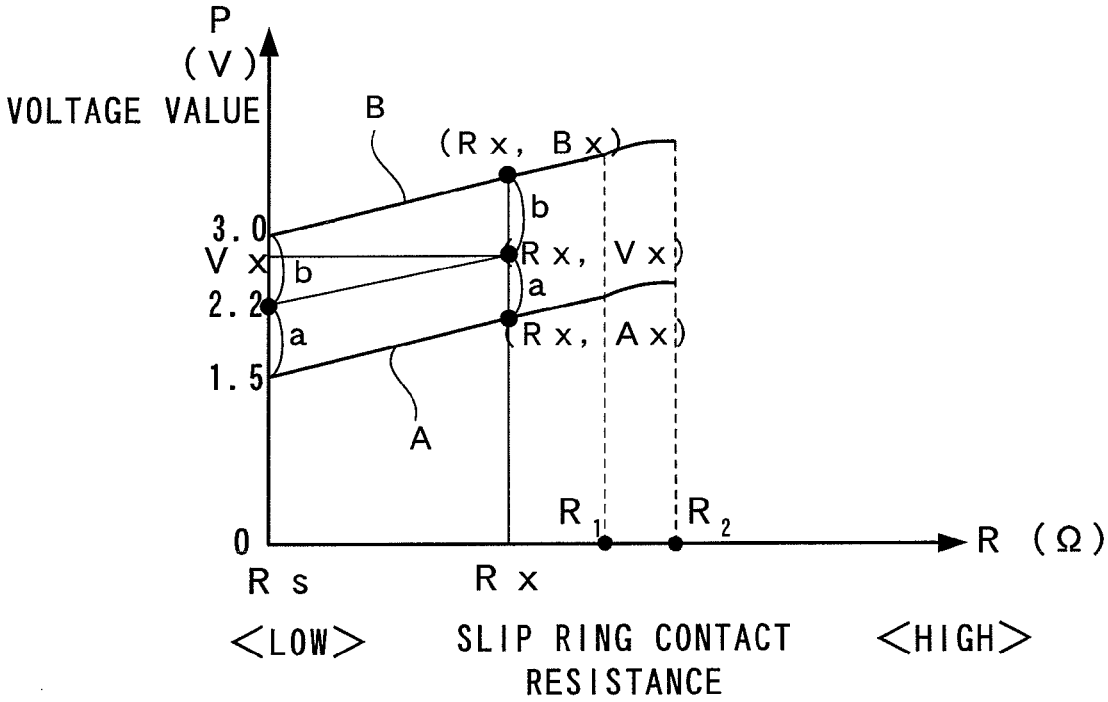
FIG. 5 is a second graphical diagram that illustrates the relation between the contact resistance and the detected voltage value.

FIG. 5 is a graphical diagram that illustrates the relation between the contact resistance and the detected voltage value.

FIG. 5 illustrates two graphs A and B between which the point (Rx, Vx) is present in the graph, among the respective graphs of the approximate expressions stored in the storage section 2011.

The graph A is the same as the graph illustrated in FIG. 4, and is equivalent to the approximate expression of the data in which the voltage true value is 1.5V. On the other hand, the graph B is equivalent to the approximate expression of the data in which the voltage true value is 3.0V.

As illustrated in FIG. 5, the point (Rx, Vx) internally divides the range between a point (Rx, Ax) in the graph A and a point (Rx, Bx) in the graph B into "a" and "b" (a:b). In this case, the controller 201 determines, as a voltage true value, a value 2.2(v) that internally divides the range between a voltage true value 1.5(v) corresponding to the graph A and a voltage true value 3.0(v) corresponding to the graph B into a:b. Further, in the controller 201, the toner density is controlled based on the voltage true value 2.2 (v) determined in this way. As a result, the toner density of the developer in the developing device 1K for the K color is controlled adequately.

Lastly, the fourth and the fifth transmission paths illustrated in FIG. 2 will be described.

As mentioned earlier, in order to obtain the voltage true value, it is necessary to acquire the voltage value detected by the second detecting section 1012 and the contact resistance between the third slip ring 1103 and the third wire brush 1113 at the time of acquiring this voltage value. However, the third slip ring 1103 and the third wire brush 1113 are used for the transmission of the signal from the permeability sensor 12K, and it is difficult to directly measure the contact resistance between the third slip ring 1103 and the third wire brush 1113.

Thus, in this printer 10, the contact resistance between the third slip ring 1103 and the third wire brush 1113 is measured by using the contact resistance between the fourth and the fifth transmission paths.

As illustrated in FIG. 2, a resistance R is connected between the fourth slip ring 1104 and the fifth slip ring 1105, and the fourth lead wire 1124 and the fifth lead wire 1125 are connected to the third detecting section 1013 of the three detecting sections included in the A/D converter 101.

To the fourth lead wires 1124 and the fifth lead wire 1125, a second power supply 1002 is connected in parallel with the third detecting section 1013. This second power supply 1002 is a constant-current power supply.

Between the fourth slip ring 1104 and the fourth wire brush 1114, and between the fifth slip ring 1105 and the fifth wire brush 1115, the same contact state as the contact state between the third slip ring 1103 and the third wire brush 1113 is obtained. Therefore, it may be said that when there is an increase in the cumulative rotation time of the revolver developing unit 1, the voltage value detected by the third detecting section 1013 represents the contact resistance between the third slip ring 1103 and the third wire brush 1113. In other words, in this slip ring system 110, as a substitution for the measurement of the contact resistance between the third wire brush 1113 and the third slip ring 1103, measurement of the contact resistance is performed with the fourth transmission path and the fifth transmission path provided aside from the third transmission path. The fourth slip ring 1104 and the fifth slip ring 1105 are equivalent to an example of another rotation terminal different from the rotation terminal according to an aspect of the present invention. The fourth wire brush 1114 and the fifth wire brush 1115 are equivalent to an example of another contact terminal different form the contact terminal according to an aspect of to the present invention. Further, the fourth transmission path and the fifth transmission path are equivalent to an example of another transmission path different from the transmission path according to an aspect of to the present invention.

In this way, the measured contact resistance is used and thus, the toner density is controlled by the controller 201 with accuracy.

Next, the second exemplary embodiment of the image forming apparatus of the present invention will be described.

In this second exemplary embodiment also, a voltage value transmitted from a permeability sensor 12K and obtained by a second detecting section 1022 (see FIG. 9) is used for controlling the toner density. In the first exemplary embodiment, the voltage true value is obtained by measuring the contact resistance. However, in the second exemplary embodiment, the voltage true value is obtained based on the cumulative rotation time of a revolver developing unit 2 and an environmental temperature in a time accumulating process.

Figure 6:
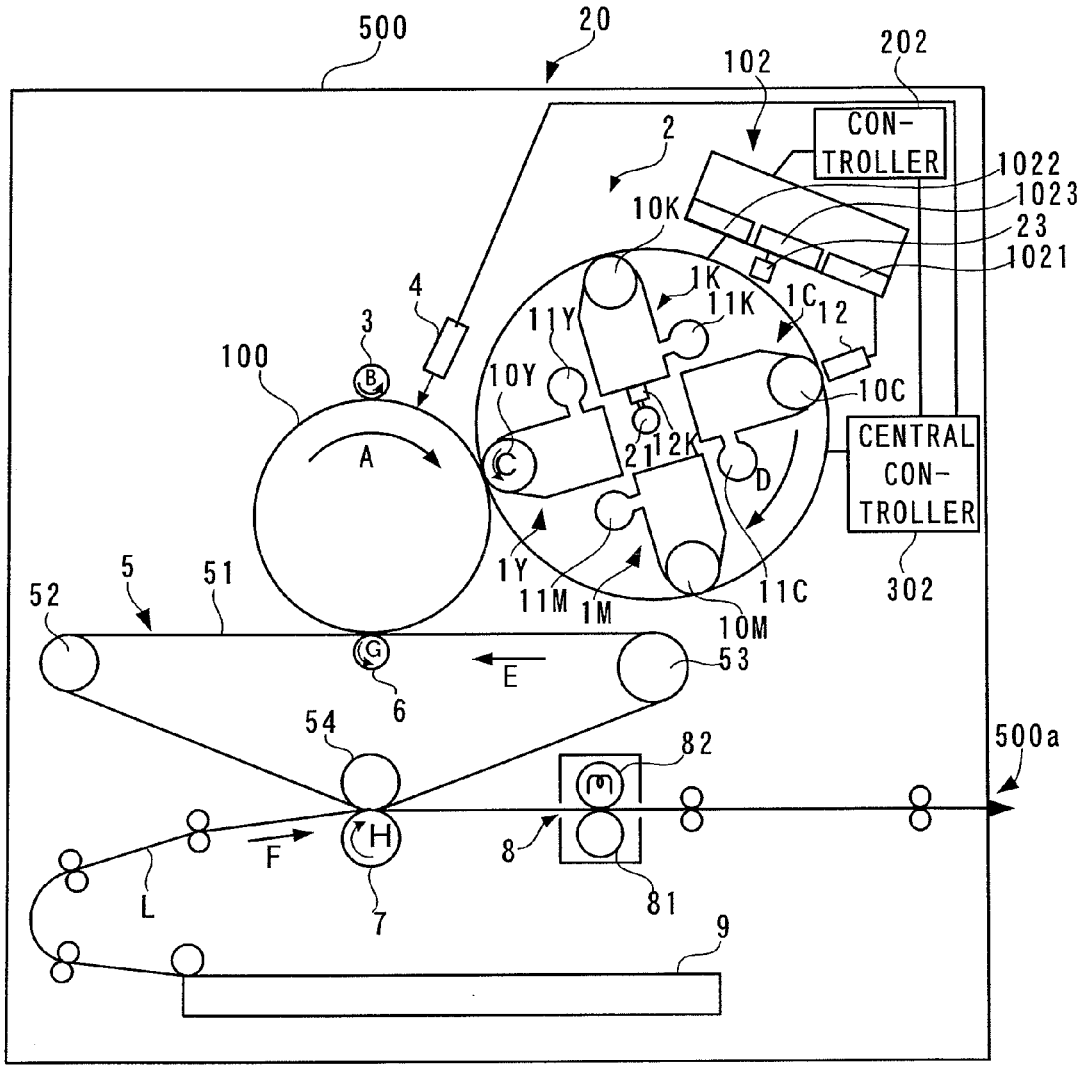
FIG. 6 is a schematic structural diagram of a printer according to a second exemplary embodiment.

FIG. 6 is a schematic structural diagram of a printer.

A printer 20 illustrated in FIG. 6 is a full color printer capable of forming a full color image on a recording medium, like the printer 10 illustrated in FIG. 1. This printer 20 is the second exemplary embodiment of the image forming apparatus of the present invention. Incidentally, among elements illustrated in FIG. 6, the same elements as those illustrated in FIG. 1 are provided with the same reference characters as those in FIG. 1.

In the printer 20 of the second exemplary embodiment, the way of determining the voltage true value is different from that in the printer 10 of the first exemplary embodiment. Thus, in this printer 20, the cumulative number of rotations of the revolver developing unit 2 is counted by a central controller 302. Further, in this printer 20, the configuration of a slip ring system 210 (see FIG. 9) is different from the configuration of the slip ring system 110 illustrated in FIG. 2. In this printer 20, a temperature sensor 23 is added. In the following, while how to determine the voltage true value in the second exemplary embodiment is described, features different from the printer 10 illustrated in FIG. 1 will be described.

In this printer 20, the cumulative rotation time of the revolver developing unit 2 is used to obtain the voltage true value as mentioned above. As illustrated in FIG. 3, between the cumulative rotation time of the revolver developing unit 2 and the contact resistance, there is such a relation that the longer the cumulative rotation time is, the larger the contact resistance is. Further, as illustrated in FIG. 4, between: the contact resistance between the third slip ring 1103 and the third wire brush 1113; and the voltage value transmitted to the second detecting section 1022 via the third slip ring 1103 and the third wire brush 1113 and detected by the second detecting section 1022, there is such a relation that the larger the contact resistance is, the larger the detected voltage value is as well. Therefore, it is conceivable that the longer the cumulative rotation time will be, the larger the voltage value detected by the second detecting section 1022 will be.

Thus, in the second exemplary embodiment, as basic information for determining the voltage true value, there is determined by experiment a change in the level (voltage value) of an analog signal detected by the second detecting section 2012 during a period of time in which the cumulative rotation time of the revolver developing unit 2 changes from 0(s) to T2(s). Then, an approximate expression is created for each of pieces of data having different voltage true values. In a storage section 2021 of a controller 202, these approximate expressions are stored.

Figure 7:
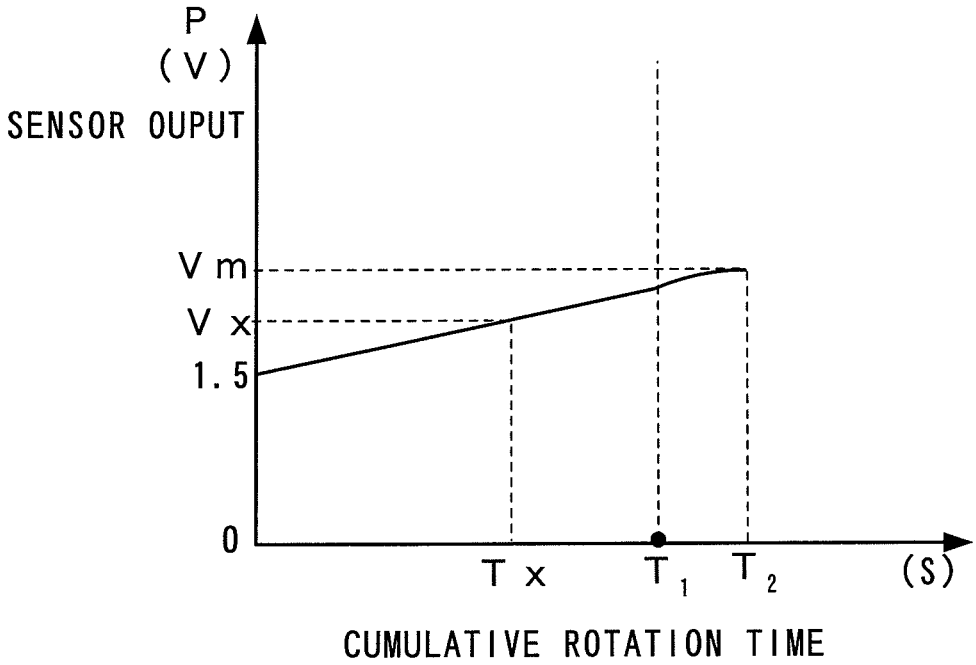
FIG. 7 is a graphical diagram that illustrates the relation between the cumulative rotation time and the detected voltage value.

FIG. 7 is a graphical diagram that illustrates the relation between the cumulative rotation time and the detected voltage value.

In FIG. 7, the relation between the cumulative rotation time of the revolver developing unit 2 and the sensor output (namely, detected voltage value), which is represented by one of the two or more approximate expressions stored in the storage section 2021 (see FIG. 9) of the controller 202, is illustrated in a graph. The horizontal axis of the graph represents the accumulation rotation time, the vertical axis represents the sensor output. The example illustrated in FIG. 7 is a case where the voltage true value is 1.5V. The graph illustrated in FIG. 7 indicates that the sensor output equals to 1.5V when the cumulative rotation time is 0(s), and the sensor output is Vm(V) when the cumulative rotation time reaches a limit T2 after increasing.

Including the approximate expression corresponding to the graph illustrated in FIG. 7, any of the approximate expressions stored in the storage section 2021 is expressed by the following form where the sensor output is represented by P and the cumulative rotation time is represented by Tx.

$$P=fTx+g(0\leq Tx\leq T_1)$$

$$P=hTx^2+iTx+j(T_1<Tx\leq T_2)$$

(f, g, h, i, j are coefficients varying among the voltage true values, and T1 is a boundary cumulative rotation time common to any of the voltage true values.)

The controller 202 determines the voltage true value as described below, based on such an approximate expression. For example, if the cumulative rotation time at the time when the voltage value Vx is detected by the second detecting section 1022 (see FIG. 9) is Tx, the controller 202 calculates each P(Tx) by substituting the Tx into each of the approximate expressions, and compares the P(Tx) with Vx. Here, when there is an approximate expression where P(Tx)=Vx, a point (Tx, Vx) is a point on the graph as illustrated in FIG. 7, and the controller 202 obtains, as the voltage true value, the voltage value P (1.5V in the example of FIG. 7) at the time when the cumulative rotation time is 0 in this approximate expression. In the controller 202, assuming that this voltage true value 1.5V is a value reflecting the toner quantity of the developer in the developing device 1K for the K color, the toner supply is controlled based on this value. This controller 202 is equivalent to an example of the correction section according to an aspect of the present invention.

Further, in this controller 202, when any of the values P(Tx) calculated as described above does not agree with Vx, the voltage true value is obtained by the same technique as that described in the first exemplary embodiment.

Incidentally, the relation between the cumulative rotation time and the contact resistance is affected by an environmental temperature.

Figure 8:
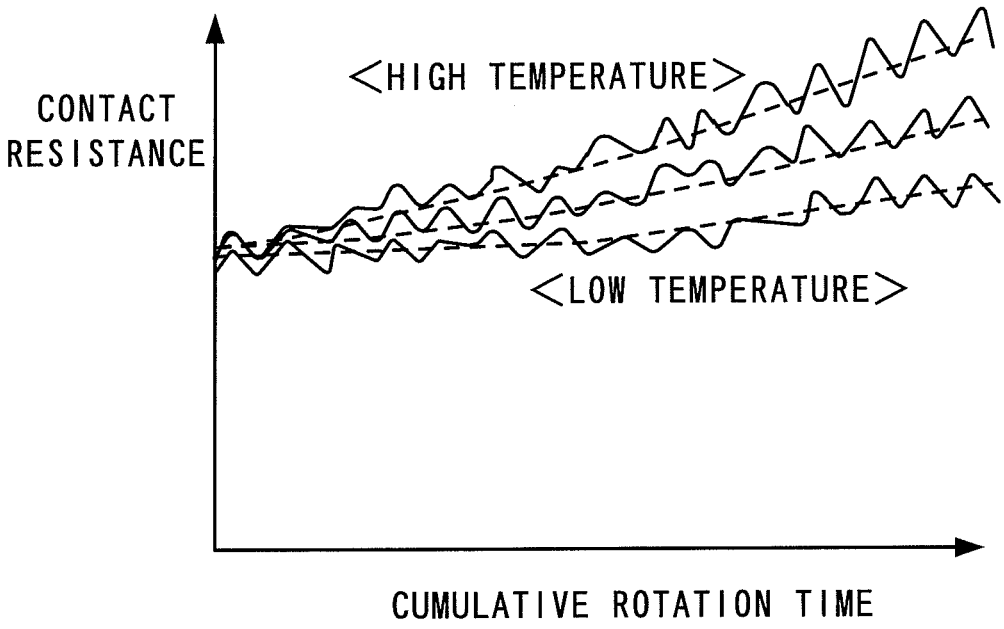
FIG. 8 is a graphical diagram that illustrates the relation between the cumulative rotation time and the contact resistance, per environmental temperature.

FIG. 8 is a graphical diagram that illustrates a relation between the cumulative rotation time and the contact resistance, per environmental temperature.

As illustrated in FIG. 8, the higher the environmental temperature is, the greater the rise in the contact resistance in response to the increase in the cumulative rotation time is. This is because a lubricant between the slip ring and the wire brush deteriorates faster with increasing temperature. Therefore, it is conceivable that even when the cumulative rotation hours are the same, if the environmental temperatures in the process of accumulating the rotation time vary, the contact resistances may vary. For this reason, as mentioned earlier, when the voltage true value is determined, it is desirable to take the environmental temperature into consideration.

Thus, in this printer 20, the temperature sensor 23 described above is provided near a rotation axis 21 (see FIG. 9) of the revolver developing unit 2, and the cumulative rotation time is associated with the temperature at that time and stored in the storage section 2021.

Figure 9:
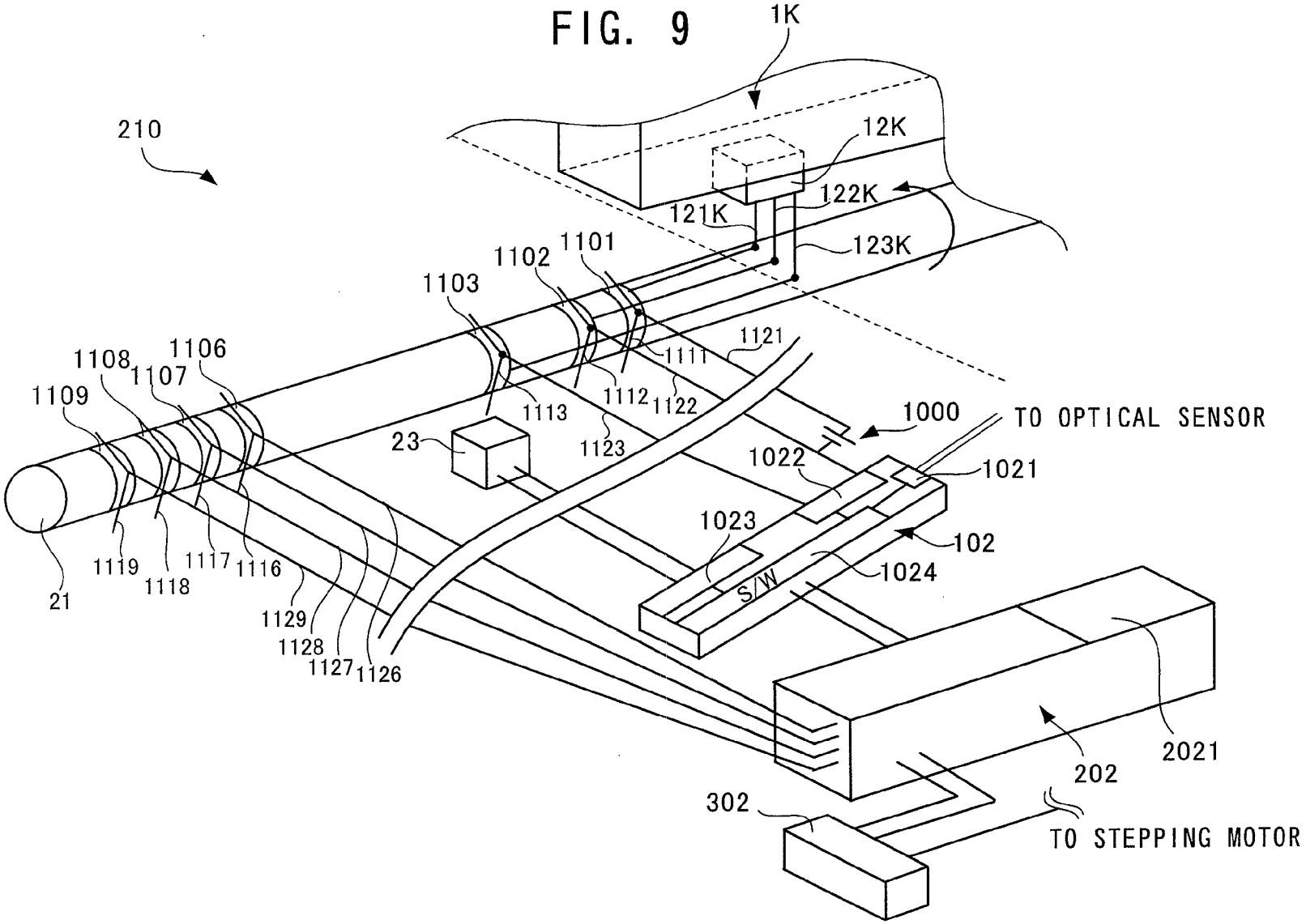
FIG. 9 is a schematic structural diagram of a slip ring system in the printer according to the second exemplary embodiment.

FIG. 9 is a schematic structural diagram of the slip ring system in the printer of the second exemplary embodiment.

FIG. 9 illustrates a state in which the temperature sensor 23 is provided near the rotation axis 21 of the revolver developing unit 2 in this printer 20.

Further, in the central controller 302 of this printer 20, as described above, the cumulative rotation time of the revolver developing unit 2 is measured, and the measurement result is transmitted to the controller 302. In the controller 302, the environmental temperature detected at the time when the cumulative rotation time is updated is associated with the cumulative rotation time and stored in the storage section 2021. Incidentally, the fourth and the fifth transmission paths, which are provided in the printer 10 of the first exemplary embodiment to grasp the contact resistance between the third slip ring 1013 and the third wire brush 1013, are not provided in the printer 20 of this second exemplary embodiment.

FIG. 10A and FIG. 10B are diagrams that illustrate the correspondence between each piece of data on the cumulative rotation time and each piece of data on the environmental temperature.

FIG. 10A illustrates the content of the data stored in a not-illustrated EEPROM of the central controller 302. In this EEPROM, the updating date of the cumulative rotation and the cumulative rotation time before the updating date are stored. In the central controller 302, the current cumulative rotation time is transmitted to the controller 202 on the day when the cumulative rotation time is updated.

On the other hand, in the controller 202, a daily average temperature is stored based on the temperature information from the temperature sensor 23. As illustrated in FIG. 10B, when the cumulative rotation time is transmitted from the central controller 302, the average temperature on the updating date and the transmitted cumulative rotation time are associated with each other and stored.

In this way, in the controller 302 , the environmental temperature in the process of accumulating the cumulative rotation time of the revolver developing unit 2 may be tracked.

The approximate expression described above is an expression obtained by the experiment in the temperature range (below 20° C.) that does not affect the deterioration of the lubricant. When the temperature range of 20° C. or more is included in the environmental temperature in the actual process of accumulating the cumulative rotation time, the rotation time in this temperature range of 20° C. or more is multiplied by a coefficient to be described later, and converted into an equivalent rotation time in the environmental temperature of below 20° C. By using the cumulative rotation time thus obtained by the conversion, the voltage true value in which the environmental temperature is considered is obtained in the above described way.

Figure 11:
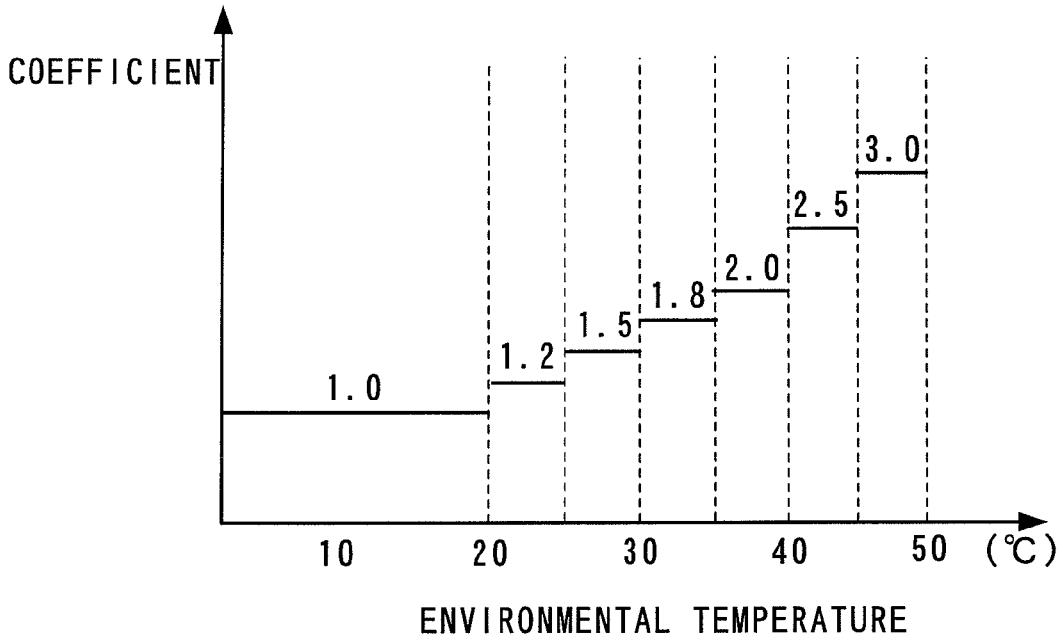
FIG. 11 is a graphical diagram that illustrates the relation between environmental temperature ranges and conversion coefficients.

FIG. 11 is a graphical diagram that illustrates the relation between the environmental temperature range and the conversion coefficient.

FIG. 11 illustrates the result of turning the influence of the environment temperature (see FIG. 8) on the relation between the cumulative rotation time and the contact resistance into coefficients, based on the environment temperature range from 0° C. to below 20° C. irrelevant to the deterioration of the lubricant.

As illustrated in FIG. 11, a coefficient 1.0 is set for the cumulative rotation time elapsed in the environment temperature range from 0° C. to below 20° C. serving as the basis for turning the influence into the coefficients. A coefficient 1.2 is set for the cumulative rotation time elapsed in the temperature range from 20° C. or more to below 25° C. Further, a coefficient 1.5 is for the cumulative rotation time elapsed in the temperature range of 25° C. or more to below 30° C. The higher the temperature range is, the larger the set coefficient is.

Therefore, in this printer 20, as illustrated in FIGS. 10A and 10B, the cumulative rotation time currently revealed is 18 hours, and 5 hours of which are accumulated at the environmental temperature of 22° C. The subsequent 7 hours are accumulated at the environmental temperature of 26° C. The last 6 hours are accumulated at the environmental temperature of 19° C. In this case, the conversion into the cumulative rotation time in the temperature range (below 20° C.) that does not affect the deterioration of the lubricant is performed as follows. At first, the first 5 hours become 6 hours by 5×1.2=6, and the next 7 hours become 10.5 hours by 7×1.5=10.5. Furthermore, the last 6 hours are in the temperature range (below 20° C.) that does not affect the deterioration of the lubricant and thus, remain as 6 hours by 6×1.0=6. Therefore, the cumulative rotation time 18 hours currently revealed become 23.5 hours by the conversion. In the controller 202, the voltage true value is obtained, by using the accumulation rotation time 23.5 hours after this conversion and the approximate expressions which are obtained by the experiment in the temperature range from 0° C. to below 20° C. and stored in the storage section 2021. As a result, the printer 20 of the second exemplary embodiment also controls the toner density of the developer in the developing device 1K for the K color appropriately.

In each of the exemplary embodiments, the printer is taken as an example of the image forming apparatus according to an aspect of the present invention. However, the image forming apparatus according to an aspect of the present invention is not limited to the printer and may be a copying machine or a facsimile that forms images based on data read by an image reader.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier on a surface of which an image is formed and carries the image;

a rotation device that has a plurality of image-forming devices each including a toner and forming a toner image on the surface of the image carrier with the toner, causes one of the image-forming devices to face the surface of the image carrier and to form the toner image, and rotates to change the image-forming device facing the surface of the image carrier;

a detector that is attached to at least one image-forming device of the plurality of image-forming devices, and detects a quantity of the toner included in the at least one image-forming device, to output an analog signal representing the quantity;

a transmission path that transmits the analog signal outputted by the detector, to the outside of the rotation device, and that includes a rotation terminal which is mounted on the rotation device and rotates together with the rotation device, and a contact terminal which is provided outside the rotation device, and contacts a surface of the rotation terminal to maintain continuity with the rotation terminal even when the rotation terminal rotates; and a correction section that corrects the analog signal transmitted through the transmission path according to a contact resistance between the rotation terminal and the contact terminal.

2. The image forming apparatus according to claim 1, further comprising:

a measurement section that measures the contact resistance between the rotation terminal and the contact terminal, wherein the correction section corrects the analog signal according to the contact resistance measured by the measurement section.

3. The image forming apparatus according to claim 2, further comprising:

another transmission path that is provided along with the transmission path, transmits an electrical signal, and includes another rotation terminal which is mounted on the rotation device, rotates together with the rotation device, and is provided along with the rotation terminal, and another contact terminal which is provided outside the rotation device, and contacts a surface of the another rotation terminal to maintain continuity with the another rotation terminal even when the another rotation terminal rotates, wherein the measurement section causes the another transmission path to transmit an electrical signal and obtains the transmitted electrical signal, to measure a contact resistance between the another rotation terminal and the another contact terminal corresponding to the contact resistance between the rotation terminal and the contact terminal.

4. The image forming apparatus according to claim 1, wherein the correction section performs correction affecting the contact resistance between the rotation terminal and the contact terminal according to an accumulation of rotation of the rotation device.

5. The image forming apparatus according to claim 4, wherein the correction section performs correction according to both the accumulation of the rotation of the rotation device and an environmental temperature affecting the contact resistance between the rotation terminal and the contact terminal.

* * * * *